US005873797A

United States Patent [19]

Garn

[11] Patent Number: 5,873,797

[45] Date of Patent: Feb. 23, 1999

[54] REMOTE GOLF BALL LOCATOR

[75] Inventor: Brad Garn, Mesa, Ariz.

[73] Assignee: Leading Edge Technologies, Inc., Chandler, Ariz.

[21] Appl. No.: 832,001

[22] Filed: Apr. 3, 1997

[51] Int. Cl.[6] ..... A63B 57/00

[52] U.S. Cl. ..... 473/407; 473/409

[58] Field of Search ..... 463/407, 131, 463/169, 409; 364/411.1; 342/357; 340/323 K

[56] References Cited

U.S. PATENT DOCUMENTS

| | | |
|---|---|---|
| 4,480,310 | 10/1984 | Alvarez . |
| 4,703,444 | 10/1987 | Storms, Jr. et al. . |
| 4,783,071 | 11/1988 | Tattershall . |
| 4,910,677 | 3/1990 | Remedio et al. . |
| 5,044,634 | 9/1991 | Dudley . |
| 5,056,106 | 10/1991 | Wang et al. . |
| 5,095,430 | 3/1992 | Bonito et al. . |
| 5,311,195 | 5/1994 | Mathis et al. . |
| 5,364,093 | 11/1994 | Huston et al. . |
| 5,434,789 | 7/1995 | Fraker et al. . |
| 5,469,175 | 11/1995 | Boman . |
| 5,483,456 | 1/1996 | Kuwahara et al. . |
| 5,488,559 | 1/1996 | Seymour . |
| 5,507,485 | 4/1996 | Fisher . |
| 5,685,786 | 11/1997 | Dudley . |

OTHER PUBLICATIONS

"Overview of Differential GPS Methods", E. Blackwell; SRI International; Jan. 1, 1985.

*Primary Examiner*—Michael O'Neill

*Attorney, Agent, or Firm*—Blank Rome Comisky & McCauley LLP

[57] ABSTRACT

A method and system for obtaining accurate measurements of distance of a golf ball from features of interest on a hole of a golf course including tee boxes, cups, water hazards, sand traps, rough areas adjacent fairway, and cart path, uses a golf cart equipped with a computerized navigation system including a display monitor. Survey data for the course are stored in the navigation system database as part of a map of so that fixed positions of at least some of the features of the course, including the cart path and outline of the hole of the computerized navigation system, can be selectively displayed in the map or portion thereof on the cart monitor screen during play of the course. The navigation system has a capability to detect and indicate the real time position of the golf cart as an icon on the course map displayed on the monitor screen, and has, in its database, a ball icon line approximating the longitudinal center-line of the hole. A ball icon is established distinct from the cart icon for display in the map on the monitor screen, and is arranged to move along the ball icon line in unison with movement of the cart icon along the cart path. Distance measurements are enabled and displayed from the ball icon to features on the map when the features are respectively selected by a pointer on the monitor display. A positioning device is provided to move the ball icon from the ball icon line to approximate the position of a ball in play on the hole to measure distance to a selected feature.

20 Claims, 4 Drawing Sheets

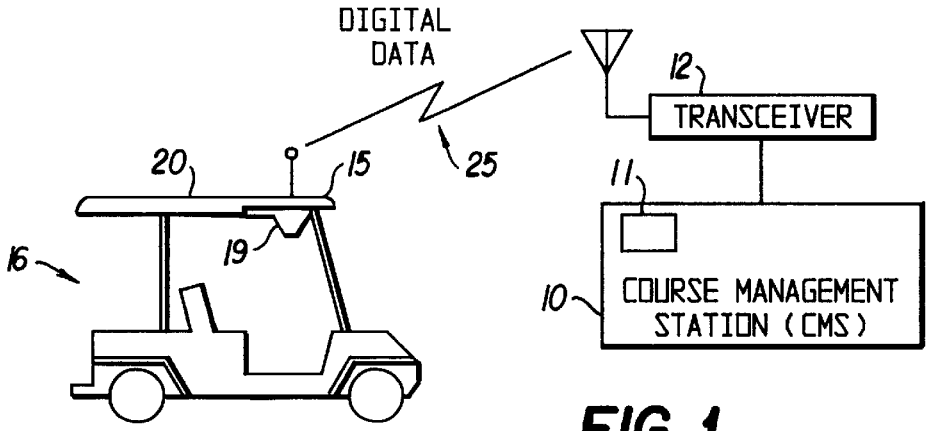
FIG. 1
FIG. 2
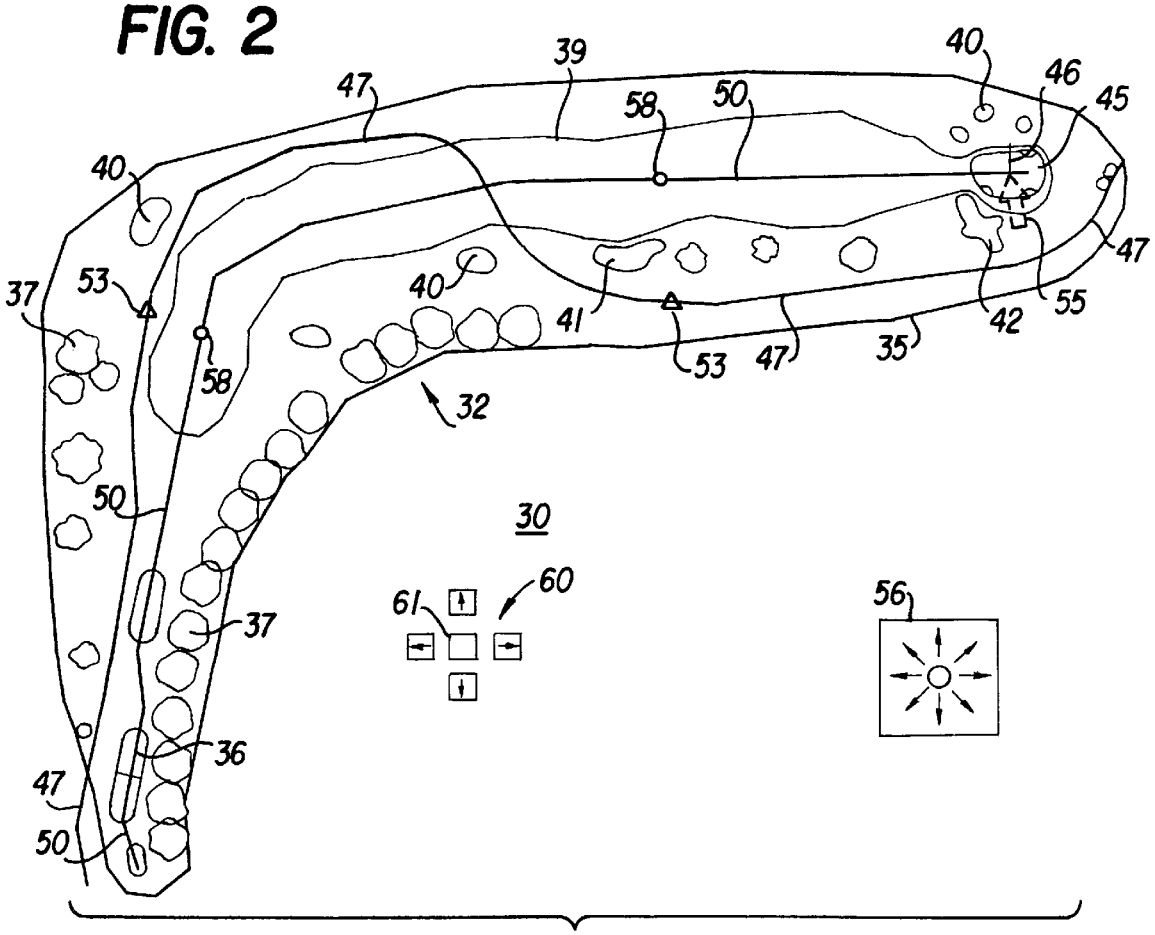

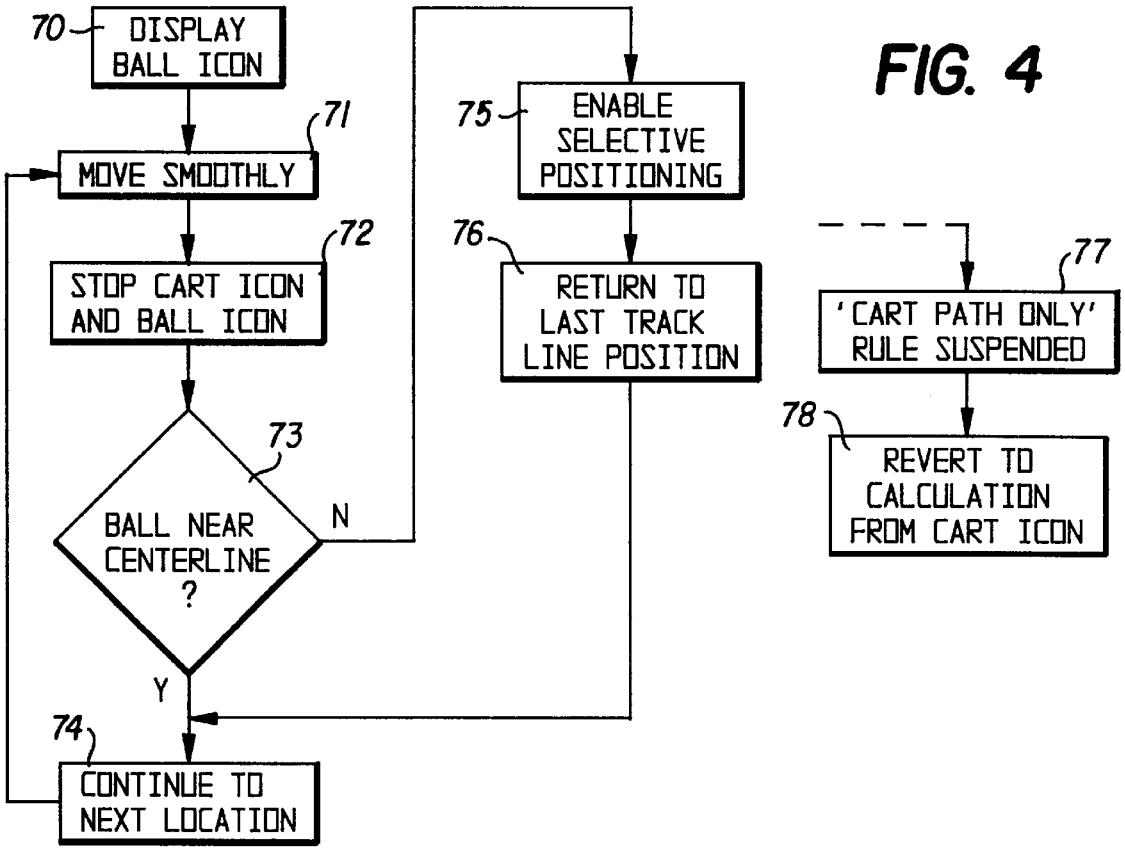
FIG. 4
FIG. 5
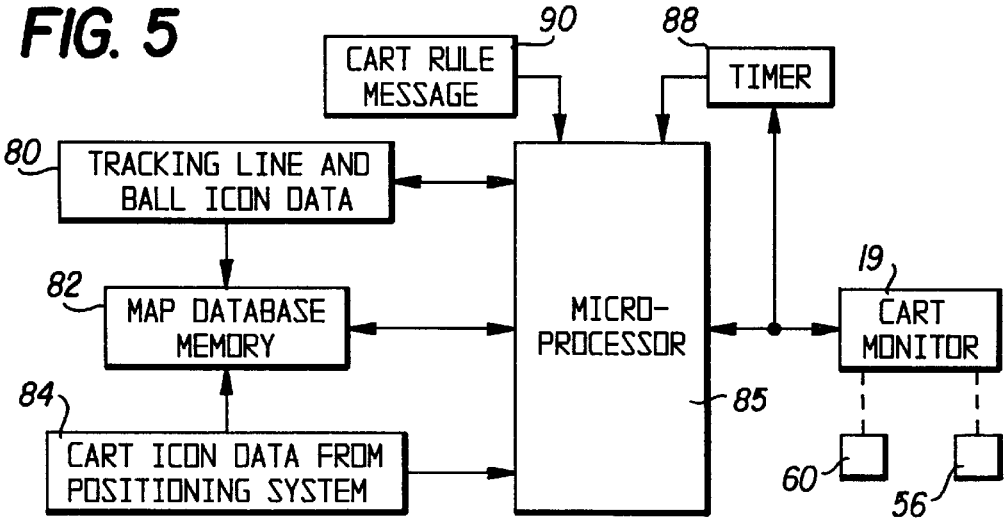

REMOTE GOLF BALL LOCATOR

BACKGROUND OF THE INVENTION

The present invention ralates generally to position, distance measuring, and navigation systems, and more particularly to improvements in such systems for golf course applications to provide greater accuracy in use by golfers to compute distances from present position to the green, the cup and other features of the hole being played.

In golf players are more comfortable and more likely to excel on courses with which they are familiar. It is customary for a golfer on a new or little-played course to seek to gain at least some familiarity with the layout of each hole before starting play. Armed with this information, the golfer can approach each tee box during play of the course, knowing, for example, whether the particular hole is a 'dog leg left', a 'dog leg right', or straight; the general locations of hazards, such as sand traps, bunkers, and water traps on the hole; and locations of range postings, if any, for calculating yardage from the golfer's location to the front and rear of the green, the pin (cup), a hazard, and a desired lay up position for the green approach shot.

Golf courses have traditionally made available course layout and feature information booklets in the pro shop, for just such purposes. Yardage markers typically are placed at sprinkler heads along each hole, to provide range information from that point to the center of the green. These serve as aids to the player, but they also contribute to slowing the pace of play of the course. Slow play has an adverse effect on the course's daily revenue, as well as on other golfers' enjoyment of the game.

Previously proposed improvements to golf course information and navigation systems have included use of buried electrical wires in various layouts on the course for interaction with mobile overland components (e.g., U.S. Pat. No. 5,044,634); and use of radio direction finding or triangulation techniques (e.g., U.S. Pat. No. 4,703,444 and U.S. Pat. No. 5,056,106). With more recent improvements in navigation and positioning systems, such as the government-sponsored Global Positioning System (GPS)—a technology now more than twenty years old—proposals have been advanced for use of other navigation systems, including GPS, on golf courses.

In co-pending U.S. patent application Ser. Nos. 08/423,295 and 08/525,905 of R. W. Rudow et al., filed Apr. 18, 1995 and Sep. 8, 1995, respectively, assigned to the same assignee as the present application ("the '295 and '905 applications"), improvements are disclosed in golf course positioning, yardage measuring and navigation systems utilizing differential GPS (DGPS) (see, for example, Blackwell, "Overview of Differential GPS Methods", *Global Positioning System*, vol. 3, pp. 89–100, The Institute of Navigation, Washington, D.C. (1986)). DGPS offers considerable error reduction in distance measurement over standard GPS, but still not quite adequate for the yardage accuracies demanded in the golf course setting.

The '295 and '905 applications provide enhancements, including unique filtering algorithms among other things, which offer considerably improved accuracy in measurements from a cart-based GPS receiver to the cup or other features, such as hazards and so forth, on a hole being played. A full color map of the golf course or individual holes or portions of a hole and all of their respective features to the extent surveyed and incorporated in the map database, are displayed on a video monitor in the cart. An icon such as a triangle representing the golf cart is also displayed on the monitor screen, in its real time position on the map of the course. By using a position selecting device proximate the monitor, the golfer can move a cursor arrow or pointer on the screen to a feature on the hole in play, such as the cup (variously also referred to as the pin or the flag), and request the system to calculate from the map database and display on the screen the real time yardage between the cart and the feature pointed to is, superimposed on the map. Such features as the tee box and pin placement may be changed each day by the course administrator but those changes are incorporated into the navigation system database by the administrator's base station so that the golfer is able to obtain an accurate measurement of the distance from the current position of the cart to the selected feature, armed with the most current data.

These and other features of the PROLINK™ yardage, course management and navigation system disclosed in the '295 and '905 applications (PROLINK is a registered trademark of Leading Edge Technologies, Inc. of Chandler, Ariz., the assignee of the latter applications as well as the present application) make it a superior golf cart-based (together with base station for course management) system with state-of-the-art graphics. An automatic zoom feature increases the selected target area resolution, such as to view the contour of the green or the details of a particular hazard. The user is able to make consistently better and faster club selection from the information concerning target distance and hole layout provided by the PROLINK™ system.

The system also allows a similarly equipped cart itself to be conveniently used for collecting survey data to map the layout of the course and its hole outlines, tee boxes, greens, cups, fairways, rough, cart paths, water hazards and sand traps, at the time the system is to be installed on the course. The collected survey data is processed, stored in memory as part of the data base, and available for later retrieval and display to aid in computing distances and indicate real time position of the cart and relative fixed positions of such features of the course. The course layout data is also useful for detecting the location of a golf cart within predetermined zones created using a zone detection algorithm, which additionally enables various system features such as automatic hole display on the cart monitor as the cart enters the tee box zone of a new hole, and automatic pop-up advertisements, promotional messages or golf tips when the cart is in transition from one hole to the next.

When the GPS signal is lost because the cart moves behind or beneath an obstruction, such as where the course is heavily treed, or hilly, or has on-course or adjacent buildings or other structures, with consequent interruption of line of sight to the GPS satellites, the GPS/DGPS system will go out-of-service and so notify the cart user with an on-screen message until signal is restored. Partly to overcome this problem, a dead reckoning system has been developed as the ACUTRAK™ golf course yardage, information and navigation system (ACUTRAK is a trademark of Leading Edge Technologies, Inc.), described in co-pending U.S. patent application Ser. No. 08/690,962 of J. R. Coffee et al., titled "Robust Golf Navigation System" filed Aug. 1, 1996 ("the '962 application"), which is commonly assigned with this application. A DGPS capability is provided in the ACUTRAK™ system, but only for purposes of periodically or intermittently calibrating the system. Apart from those distinctions, the ACUTRAK™ system shares many of the desirable attributes of the PROLINK™ system. The unique ACUTRAK™ dead reckoning (DR) guidance or navigation system tracks the distance moved by and the orientation of the wheels of the cart, extrapolated to the heading of the cart.

The system is unaffected by inability to "view" a satellite navigation system, such as the GPS satellites, and operates with considerable accuracy with limited calibration during play. Calibration operates to remove the buildup of error in the wheel sensors, compass alignment, and other component-introduced error, which will again undergo gradual increase after a calibration as the cart is driven about the course during a round of play.

A co-pending patent application of J. R. Coffee, titled "Map-Matching Golf Navigation System" (Attomey's Docket 1304.014, hereinafter the "0.014 application"), filed on Mar. 31, 1997, and commonly assigned herewith, discloses a calibration technique for a modified ACUTRAK™ system which takes advantage of a cart path map database to substantially eliminate built-up DR error in circumstances where the cart is either restricted to the typically paved or otherwise well-maintained cart path found on most U.S. courses, or is likely to be on the path at least part of the time during play of each hole.

A significant percentage of golf courses in the United States invoke a "cart path only" rule which requires that the golf cart (the use of which is mandatory for play of those and most other courses) be restricted to cart paths, and that it not be driven on the fairway. In Japan, virtually all golf courses mandate a "cart path only" rule at all times. Even for many courses where the "cart path only" rule is not in effect at all times, it is a requirement on occasions when the course "manicure" may be affected by allowing carts to be driven on the fairway, such as where the course is wet from recent rain or snow or immediately after heavy sprinkler usage, or where the threat of inclement weather is imminent. Driving on the fairway can cause ruts which will adversely affect the path of the ball during roll after shots by players who follow the wayward cart driver, and generally tends to disrupt the care and etiquette of the course. Virtually all courses absolutely forbid driving a golf cart off the cart path in the vicinity of the tee boxes and the greens.

Since the golf cart, and not the ball, is provided with the guidance system, the position and distance measurements calculated by these systems are all with respect to the cart. Except in the case where an appropriate yardage measurement system is implemented in a hand held unit (e.g., with an incorporated DGPS receiver), which does not at present appear to have any surging demand for use on a golf course, unless the roving unit of the guidance system can be placed in close proximity to the ball the indicated yardage to the pin or other range points on the hole is not an entirely accurate representation of the yardage from the ball to the selected point. This is particularly true where the course imposes a "cart path only" rule, so that the cart is restricted from being driven off the cart path to a position proximate that of the ball.

It is a principal object of the present invention to provide a golf course navigation system for golf carts in which the yardage (distance) measurement is automatically made with respect to the position of the ball, or very nearly so, or can readily be corrected to so indicate by manual control, despite relatively frequent inability to position the cart itself in close proximity to the ball, such as when playing on "cart path only" courses.

SUMARY OF THE INVENTION

In essence, the present invention establishes a line substantially along the nominal longitudinal center-line of the hole, and provides a separate icon from that of the cart on the display of the cart monitor, representing the position of the ball. As the cart moves down the cart path during play of the hole, the cart icon moves along the cart path on the map displayed on the monitor screen, and the ball icon moves in juxtaposition and in unison with the cart icon, accompanying it, but along the ball icon line that was established centrally of the hole and running substantially its entire length. The ball icon is also designated as the point from which any measurement of distance is made to a feature of the hole, such as the cup, by pointing at the selected feature with a pointer—an arrow or the like—on the monitor screen and requesting (e.g., by a command initiated by a compute key) a calculation and display of distance.

The purpose is to have the distance calculation reflect the location or position of the ball, rather than the location of the cart, relative to the cup or other selected feature of the hole. If the golfer is relatively skilled at the game so that his or her shot results in the ball landing in the center of the hole, then the ball icon will be positioned very near the "lie" (i.e., the resting place) of the actual ball when the cart is driven to a stop alongside its location on the cart path. The cart itself may be many yards from the ball at that point, but the more significant factor is the location of the actual ball relative to the center of the hole. If the lie is close to the center, then the distance measurement from the ball icon to the cup or other selected feature of the hole will be considerably more accurate than if the measurement were made relative to the location of the cart on the cart path, which is usually well off-center of the hole, on the hole map displayed on the cart monitor.

On the other hand, if the ball is sliced or hooked on a drive, or otherwise hit to either side of the center of the hole, the golfer may use a positioning device such as a plurality of arrow buttons, a track ball, a joy stick, or the like, which is provided on a keyboard in the cart in conjunction with the monitor, to move the ball icon to the estimated location of the ball's lie which may be very close to its actual location. The accuracy of the positioning of the ball icon vis-a-vis the true position of the ball on the course depends to a great extent whether the ball can be seen from the cart, or, if not visible at that point, was observed during its flight and to have dropped at a particular spot. If the ball has been hit into the rough, the positioning of the ball icon may be more a guess than anything else. Nevertheless, even in that situation the guessed position is likely to be much closer than the cart to the actual location of the ball, so that the distance measurement displayed on the monitor screen has much greater utility to the golfer. In either event, the yardage and range points to the pin will be with respect to the ball rather than with respect to the cart.

Of course, the golfer could seek out the location of the ball, and after finding it, return to the cart and move the ball icon to its approximate location to get a better "read" of the distance and hazards involved in planning his next shot and appropriate club selection. But this would defeat an important purpose of the navigation system, which is to speed up play of the round. Moreover, it is highly unlikely that anyone would deem it worthwhile to make two trips from the cart to the ball simply to obtain a better distance readout before the shot.

The rule of the day for cart travel on the course is selected each morning by the course manager or administrator (typically, the professional golfer or course "pro" or an assistant who operates the pro shop at which the base station of the position and distance measurement system for the course is conveniently located). Usually, for those courses which permit carts to be driven on the fairway, and where the weather is dry, a "90 degree rule" is broadcast to the carts over the communication system between the carts and the base station (see the '295 or '905 application). Golfers are notified on commencement of the day's play by a pop-up message displayed on the cart monitor screen that this rule is in effect, meaning that the cart travel is restricted to the cart path until the cart is at substantially 90° to the ball, and only then may it be driven onto the fairway, straight to the ball (i.e., substantially perpendicular to the cart path). This minimizes the extent of travel of the cart over the fairway. Another rule may allow carts to proceed over the entire fairway, i.e., so they are not restricted to the path even for short distances. However, the rule employed by courses that are most particular about course manicure and etiquette, or where the course is wet, is the "cart path only" rule, which dictates that no cart is allowed on the fairway off the cart path for any reason.

A feature of the invention is that when the rule changes from either "90 degree rule" or no restriction to "cart path only" rule, the system of the invention may be implemented to revert automatically to cart path only play, i.e., from distance measurements relative to the cart icon to distance measurements relative to the ball icon (or vice versa if the change in rule were the other way). When the ball icon is not in use, it is preferably suppressed from display to reduce clutter on the monitor screen.

An algorithm is used for moving the ball along its tracking line. The tracking line or ball icon path extending longitudinally along substantially the center-line of the hole is created in the process of map-making (e.g., using a cart equipped with the PROLINK™ or ACUTRAK™ navigation system), as part of the post-processing of the collected survey data. When the cart is being driven along the cart path, the cart icon similarly moves along the cart path on the map displayed on the monitor by virtue of the position and navigation system being used, and the ball icon should move along its tracking line in unison with the cart icon's movement. The tracking line is piecewise linear, and the desire is that the ball icon smoothly track the cart icon's movement, without hesitation or jerky motion. A problem is encountered in implementing a suitable algorithm for such ball icon tracking, for the situation where the ball icon rounds a corner.

In such a situation, the ball icon moves through an arc, the ends of which are equidistant from the cart icon. If the algorithm were based in some fashion on distance between ball icon and cart icon, the ball icon could simply jump from one end of the arc to the other because the distance to the cart icon is the same for both ends. Or the ball icon could be made to remain in the corner while the cart icon traverses its typically smoother curve. According to another aspect of the invention, then, the tracking algorithm employs weighted averaging of slopes presented by the relationship between cart icon and ball icon on the display map, to alleviate the problem and assure smooth movement of the ball icon during tracking.

When the cart is stopped, the cart and ball icons also cease their respective movement, and readout ofthe fixed distance between ball and cup may be obtained to aid club and shot selection. If the lie of the ball is such that the ball icon must be moved off its tracking line to the estimated position of the actual ball on the display map to derive the more accurate measurement, it must then be returned to the tracking line to resume movement therealong when the cart is again being driven along the cart path.

According to yet another feature of the invention, a distance calculation requested after the ball icon is moved off-track results in the setting of a timer. Unless another distance calculation and display is requested before the timer times out, the ball icon is automatically returned to the position it occupied on the tracking line at the time its movement stopped. In that way, the ball icon will resume its travel along the tracking line in concert with movement of the cart icon and in the exact juxtaposition therewith that had existed before the stop. Alternatively, the ball icon may be shifted back to the original point of the stop (which is stored in memory) when it is manually returned to the tracking line by use of the positioning device, or when the cart itself commences movement. An automatic return from the off-track position is preferred for convenience to the golfer, to avoid a need for an additional manual operation. As with any computer-based system intended for use by members of the general public, the desire is to maintain a simple, user-friendly operating modality.

The invention is not limited to or conditioned upon use with any particular golf course navigation system, being equally useful with systems that employ GPS, DGPS, or other satellite-based operation, dead reckoning, radio triangulation, or any other type of positioning, measurement, navigation, or guidance technique.

BRIEF DESCRIPTION OF THE DRAWINGS

The above and still further objects, features, aspects and attendant advantages of the present invention will become apparent from a consideration of the following detailed description of the best mode presently contemplated for practicing the invention, with reference to certain preferred embodiments and methods, in conjunction with the accompanying drawings, in which:

FIG. 1 is a simplified diagram of a portion of golf position and distance measurement system illustrating a base station and one of the golf cart-based units of the golf course network;

FIG. 2 is a view of a map of a hole on the course much as it is displayed on the monitor screen in the golf cart, illustrating the approximate longitudinal center-line of the hole along which the ball icon moves in unison with the cart icon traveling along the cart path, according to the invention;

FIG. 4 is a flow diagram of a preferred method of use of the invention;

FIG. 5 is a block diagram of a portion of the position, distance measuring and navigation system in which the invention is implemented.

DETAILED DESCRIPTION OF THE BEST MODE

Figure 3A:
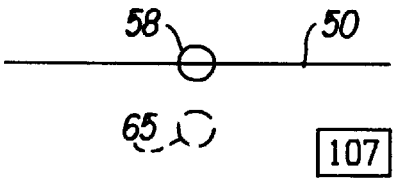
FIGS. 3A and 3B are enlarged views of a portion of the hole map illustrating the position of a ball in play near the center of the hole and the relative location of the ball icon on the nominal center-line or tracking line of the hole map, and the position of a ball off the fairway which required the ball icon to be repositioned by the cart user, respectively.

In an exemplary application of the invention, the base station and golf cart units of the positioning, distance measuring and navigation system used on the golf course may correspond generally to those described in the '962 application, which is incorporated herein by reference and to which the reader is referred, so a detailed description of them need not be presented here. Referring to FIG. 1, the system includes a base station comprising course management station (CMS) 10 which includes a video display monitor 11 and is conveniently located in the clubhouse pro shop for ease of real time monitoring of course play by the course administrator. Station 10 includes a course management computer with central processing unit (CPU) and video monitor, together with software for execution by the computer. The CMS monitor 11 displays the course map (or any selected portion thereof) with all its features, and indicates the locations of the golf carts (not shown) on the course, updated in real time as they move about the course. A transceiver 12 provides two-way radio frequency (RF) communication on network 25 between the base station and the transceiver and related system equipment 15 in each of the multiplicity of golf carts 16 in use on the course. The CMS 10 provides overall timing and master control of the cart navigation system communications network.

Each cart has a display monitor 19 to provide the display of the hole being played (or other selection such as the entire course or portion thereof over several holes, or an enlarged portion of the hole being played obtained by a zoom feature). When called for by the user by use of a cursor arrow or pointer on the screen, with or without an associated compute command key, distances to selected features on the hole are displayed on the monitor screen, including distances which are fixed in the survey data such as from tee to cup (as used herein, the terms "cup", "pin", and "flag" refer to the same point on the hole), and distances which change with position of the cart on the hole such as cart to cup and to any of various hazards on that hole.

The relative positions and distances between fixed course features, such as between tee boxes and cups, or other fixed points and hazards, as well as hole layout, are known surveyed points or boundaries for each hole stored in the computer which can be selectively called up for display at any time on the cart monitor. If desired, the survey may be performed at the time of installation of the overall system on the course, by simply driving a similarly equipped golf cart around the perimeter of the hole and the features desired to be surveyed and along linear paths or to specified points (e.g., the cup), as described in the '295 and '905 applications, which are incorporated herein at least to that extent, by reference. The map database information is supplied by CMS 10 to each cart 16, as requested. Also, network control data from CMS 10 provides timing and other information for the base station/cart communications. The variable length communications network of the cart navigation system allows all of the equipped carts to be supported by the system installed on the course. Precise system timing is provided to CMS 10 by a pulse per second (PPS) signal implemented as an interrupt to the CMS computer, for system timing to near microsecond ($\mu$s) levels to precisely control RF communication.

FIG. 2 illustrates a typical display 30 on cart monitor 19, in a cart and system utilizing the present invention. The screen depicts the map of a hole 32 of the golf course having a "dog leg right" layout. The map database is stored in memory in the cart system or acquired as needed from the database stored in the base station CMS, by means of the communication system between cart and CMS. The map data itself is acquired from a survey conducted prior to or at the time of installation of the position, distance measurement and navigation system on the course. To that end, a golf cart equipped with a GPS/DGPS system is driven around the perimeter (e.g., 35) of each hole of the course, and around the perimeter of each feature (e.g., tee boxes 36, trees 37, fairway 39, sand traps 40, water hazards 42, green 45) to be displayed on the cart monitor and the base station monitor, or along the path of longitudinal features (e.g., cart path 47), or to the position of point-type features (pins or cups 46), to collect survey data. The data is then post-processed to develop vector lists, discard superfluous data points, and ultimately compress the data in digital format for storage in the system database.

According to an important aspect of the invention, a piecewise linear line 50 is established as the ball icon line or tracking line and is stored in the map database, substantially coinciding with the longitudinal center-line of hole 32 (and similarly for each hole on the course). It should be understood that it is not essential to the practice of the invention that this line (which may or may not be displayed on the screen, the showing in FIG. 2 being simply for clarity of description) be coincident with the hole center-line. It could be set elsewhere on the hole and might follow a meandering path, even more so than the cart path 47. But its purpose is to allow ease of obtaining distance measurements or calculations that more nearly reflect the distance from the position of the ball in play on the course to the course or hole feature of interest, rather than from the position of the cart. For that reason, a substantially invariant longitudinal line (relative to the layout of the hole—here, 'dog leg right') that substantially coincides with the center-line of the hole (or fairway), and that runs substantially the entire length of the hole from tee to green (and beyond, if desired), is preferred.

A cart icon 53 on the map displayed on the monitor screen tracks the position of the golf cart as it traverses the hole, and throughout the course. In the context of the present invention, it is assumed that the cart cannot be driven to the actual location of the ball, but is instead restricted to movement solely along the cart path 47, by virtue of the course administrator having invoked the "cart path only" rule, either permanently, or as a temporary measure because of current or imminent course conditions. Accordingly, since the distance to hole features in the map database is computed from the navigation system roving unit—here, the golf cart equipped with the position, distance measuring and guidance equipment, whether a GPS receiver, a dead reckoning computer and associated communications equipment, or other—, the distance displayed on the screen when a pointer (cursor arrow or the like) 55 is positioned on the screen at a selected feature (e.g., cup 46) by a positioning device joystick 56, operated by the cart user), and a computation is requested, is the distance between the cart, not the ball, and the feature.

To produce and display a more accurate measure of the distance of interest for purposes of a golf shot and club selection, a ball icon 58 is also displayed on the screen and is arranged and adapted to move automatically with the cart icon 53, alongside it, as the latter moves along the cart path 47 of the map, except that the ball icon follows the ball icon line or tracking line 50. Generally, this ball icon does not represent the position of the actual ball except when the ball happens to land on or very close to the center-line of the hole and the cart is driven to a stop alongside (but some distance from) it on the cart path so that the ball icon moves to a spot overlying or in close proximity to the ball. However, it will be appreciated that for reasonably skilled golfers the ball icon will virtually always be closer to the lie of the ball, in or near the center of the fairway, than the companion cart icon constrained to the cart path would be. In the computer software, the distance is always computed from the ball icon rather than from the cart icon on the map, to the appropriate actual yardage scale of the course, whenever the distance measuring portion of the system is in the ball icon mode. During operation in the ball icon mode, the measurement of distance from the cart is disabled.

Looking at the left side of the hole portrayed in FIG. 2, if the golfer were seeking to avoid a sandtrap 41, the yardage from the ball icon to the sandtrap is significantly different from the yardage from the cart icon to the sandtrap—perhaps by an additional twenty yards or more. The golfer may believe, based on a yardage display showing distance from the cart, that her ball will fall short of the sandtrap on the next shot, whereas if the actual (or approximate actual) yardage to the ball were known, it might be apparent that her next shot could, in fact, land in the sand trap. The method and system of the present invention provide that more accurate information to enhance the play of the round.

Additionally, the ball icon is movable away from the tracking line 50 whenever the cart (and thus, the cart icon) is stopped, by means of conventional software and related ball icon positioning device such as another joystick or four (or eight) oppositely directed arrow keys 60 (with a central "compute" key 61), so that the ball icon may be repositioned on the displayed map at the estimated location of the actual ball. In that way, the distance measurement is computed to more accurately reflect the position of the ball rather than the cart.

At the right side of the hole map depicted in FIG. 2, the cart icon 53 is shown as having been moved, following the last shot, to a new position adjacent the present lie of the ball. The ball icon 58 has automatically accompanied the movement of the cart icon, and is now positioned at approximately (almost exactly) 90° to it, also adjacent the actual position of the ball in play.

Figure 3B:
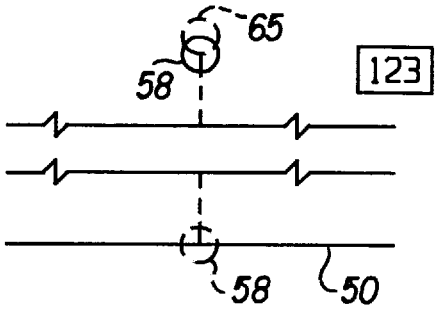

As shown in FIG. 3A, if the new position of the ball icon 58 on the tracking line 50 is very close to the actual ball 65, shown in dotted lines because, of course, it cannot be viewed on the monitor screen but only by the golfers from the vantage point of or near the cart, then the ball icon need not be repositioned at all. The distance to the cup selected by the golfer positioning pointer 55 (FIG. 2) is displayed as 107 yards. After the next shot, the cart is driven further along the cart path and the cart icon and ball icon track that movement along their separate paths. In FIG. 3B, the ball's position is much further from the center-line and, thus, from the tracking line 50 of the hole, and is also on the opposite side of the fairway from the cart. The ball icon 58 is then repositioned by the cart user (as shown by the dotted path) with arrow keys 60 to a point very close to the actual lie of the ball 65. Both the original position of the ball icon at this stop and the position of the actual ball are shown in dotted lines, and the new position of the ball icon is shown by solid line. The distance to the cup selected by the pointer is displayed as 123 yards. Here, after the timer which was set with the repositioning of the ball icon times out without a request for a new distance calculation, the ball icon is automatically returned to its original position at the last stop point of the cart, on tracking line 50.

A flow diagram of the method of the invention, which provides the position and measurement system installed on the golf course with the capability to measure distance from a golf ball in play rather than from a golf cart that utilizes the position and measurement system, is shown in FIG. 4. The golf cart, of course, is equipped with a monitor for displaying a map of the course or portion thereof being played, and for further displaying a depiction of the real time position of the cart (i.e., the cart icon) on the map to aid the cart user in playing the course. Also, the display includes a pointer for designating a feature of the course including a cup, hazards, traps, fairway, green, rough, cart path, and outline of a hole being played incorporated in the map for which distance from the cart is to be displayed on the monitor screen.

The carts calculate their positions using the installed navigation system. The mobile RF transmitter of the respective cart transmits serial data to the base station receiver identifyig the cart and its location every few seconds. By this means, the specific location of each cart is determined and identified on the digital mapping display on the base station monitor, and, as well, on the respective carts own monitor screen.

The method includes steps of displaying a depiction of a golf ball that tracks, along a line running substantially the length of the hole from at least tee box to green and substantially parallel to at least one side boundary of the hole (if not virtually coincident with the center-line of the hole itself), the movement of the cart depiction along the hole, as at 70. The ball depiction thus remains on the tracking line substantially alongside the cart depiction on the monitor screen as play proceeds along the hole. The ball depiction is caused to move smoothly along the tracking line even through arcs (or comer portions) having ends equidistant from the cart depiction, as at 71.

When the cart reaches a point adjacent to the ball, it will be brought to a stop, and, of course, the cart depiction on the monitor screen will also stop, and with it, the ball depiction, as at 72. If the ball has landed near the center-line of the hole, and cart is adjacent to it (albeit that the cart is far removed from the center of the hole), the ball depiction on the monitor at the stopping point of the cart (and cart icon) will be deemed to be close enough for a reasonably accurate measurement (calculation by the system) of the distance from the ball to the pin or any other selected feature, and the cart will then be moved, after the next shot, to the new location of the ball, as at 73 and 74. But if the ball is not near the center-line, then selective positioning of the ball depiction off the tracking line is enabled to approximate the actual lie of the golf ball in play, as at 73 and 75, to display the approximate distance from the actual golf ball rather than from the cart to the selected feature on the monitor screen. This selective positioning is preferably permitted only when the ball depiction is at a stop.

After the distance calculation(s) requested by the cart user is completed, the ball depiction is automatically returned to the last position it occupied on the tracking line after the stop, in preparation for resumption of movement along the tracking line in unison with movement of the cart depiction, when the cart resumes travel along the cart path to the next location, as at 76, 71 and 74.

If the "cart path only" rule is suspended on the course, the message from the course administrator (base station) that notifies the golf carts of that situation is used to trigger a suspension of the display of the ball depiction and selective positioning capability thereof, and a concomitant reversion to measurement of distances to selected features from the cart depiction, as at 78. The latter is the default condition for the distance calculations in the system. The rationale for this is that the cart can now move sufficiently close to the ball to constitute a reasonably close approximation of distance from the ball to the selected feature. That situation would generally prevail if golfers were free to decide where and when to drive their carts on the course. Additionally, the change relieves the system from additional program instructions and execution by, for example, a microprocessor and associated memory and peripherals to control movement and calculations associated with the ball depiction.

An exemplary subsystem for obtaining accurate computations of distance of the golf ball from selected features of interest that have been surveyed and are part of the map of the course stored in the database of the computerized navigation/positioning system used in the carts for the course is illustrated in FIG. 5. Initially, means 80 are provided for inputting data establishing a tracking line along the center of the hole approximating the longitudinal center-line of the hole into the database memory 82 of the navigation system, along with the data for a ball icon distinct from the cart icon. At least the ball icon (if not also the tracking line) is displayed with the cart icon (obtained from data supplied by the cart's positioning system at 84) in the map on the cart monitor screen 19, where movement of the two icons take place in unison as described above, as controlled by microprocessor 85 through execution of instructions from program memory.

The microprocessor also computes distances from the ball icon (or cart icon, depending on whether or not the subsystem is in the "cart path only" mode) to selected features of the course by interaction with the cart monitor under the influence of pointing and positioning devices 56 and 60 and compute command key 61 (FIG. 2), along with retrieval of data from the map database memory 82. The computed distances are then temporarily displayed as each feature is selected, on the monitor screen. To that end, the distance display may be timed to disappear from the screen within a predetermined interval after the selection is made. As described above in conjunction with FIG. 2, the pointing device 56 is used to move the cursor arrow to the feature desired as the second end point—the ball icon or cart icon (depending on mode) being the first end point—for calculation of the distance therebetween. The arrow keys 60 serve to position the ball icon at the estimated actual lie of the ball for that purpose.

As will be described in greater detail below in connection with FIG. 6, the means 80 for establishing the ball icon includes means for moving it relatively smoothly along the tracking line, and doing so even in the presence of what might be viewed as relatively sharp curves in the tracking line relative to the trajectory or pathway of the cart path. The microprocessor is responsive to instructions dictating movement of the cart icon emanating from the positioning/navigation system at 84, to cause movement of the ball icon in unison therewith on the monitor screen as the respective cursor and icon position data are supplied to the cart monitor, and to stop movement of the ball icon when the cart icon stops.

A timer 88 is triggered by the microprocessor when a distance calculation is called for to a feature selected by the pointer and the ball icon is stopped, either on the tracking line or after movement away from the tracking line. These events indicate that the ball icon has been positioned at (or near) the site of the ball. The ball icon is to be restored to its last position on the tracking line when the cart icon stopped, after a distance measurement has been displayed, so that the two will resume movement in juxtaposition along the tracking line, when the cart resumes its movement along the cart path. If the ball icon has not been moved along or off the tracking line for the distance measurement (because the ball is located near the center of the fairway, and the cart was stopped relatively close to its position), no restoration of position is necessary. The timer is set to time out within a period that will comfortably allow the golfer sufficient time to read the distance displayed on the screen, and to enter any other requests for distance calculations relative to the present position of the ball, such as to sandtraps or other hazards being faced in an approach shot on the hole. Each new request restarts the timer. Alternatively or additionally, the microprocessor may be instructed to return the ball icon automatically to its last stop position on the tracking line to resume its movement with the cart icon whenever the cart commences movement (signifying that the golfer has completed the shot or is still looking for the ball).

If the system is installed on a course in which the "cart path only" rule is always in effect, the ball icon mode is the dominant mode for the distance calculation subsystem. In all other cases, however, the preferred embodiment and method is that the ball icon display is suppressed and the system automatically reverts to measurement/calculation of actual course distances from the cart (cart icon) to features selected by the pointer, whenever the "cart path only" rule is either revoked, or not invoked at the beginning of play on the cart message system, by the course manager. Thus, for example, if the cart rule message 90 from the base station is either omitted altogether (on a non-"cart path only" course) or is other than "cart path only", microprocessor 85 is operative to institute the suppression and reversion.

Figure 6:
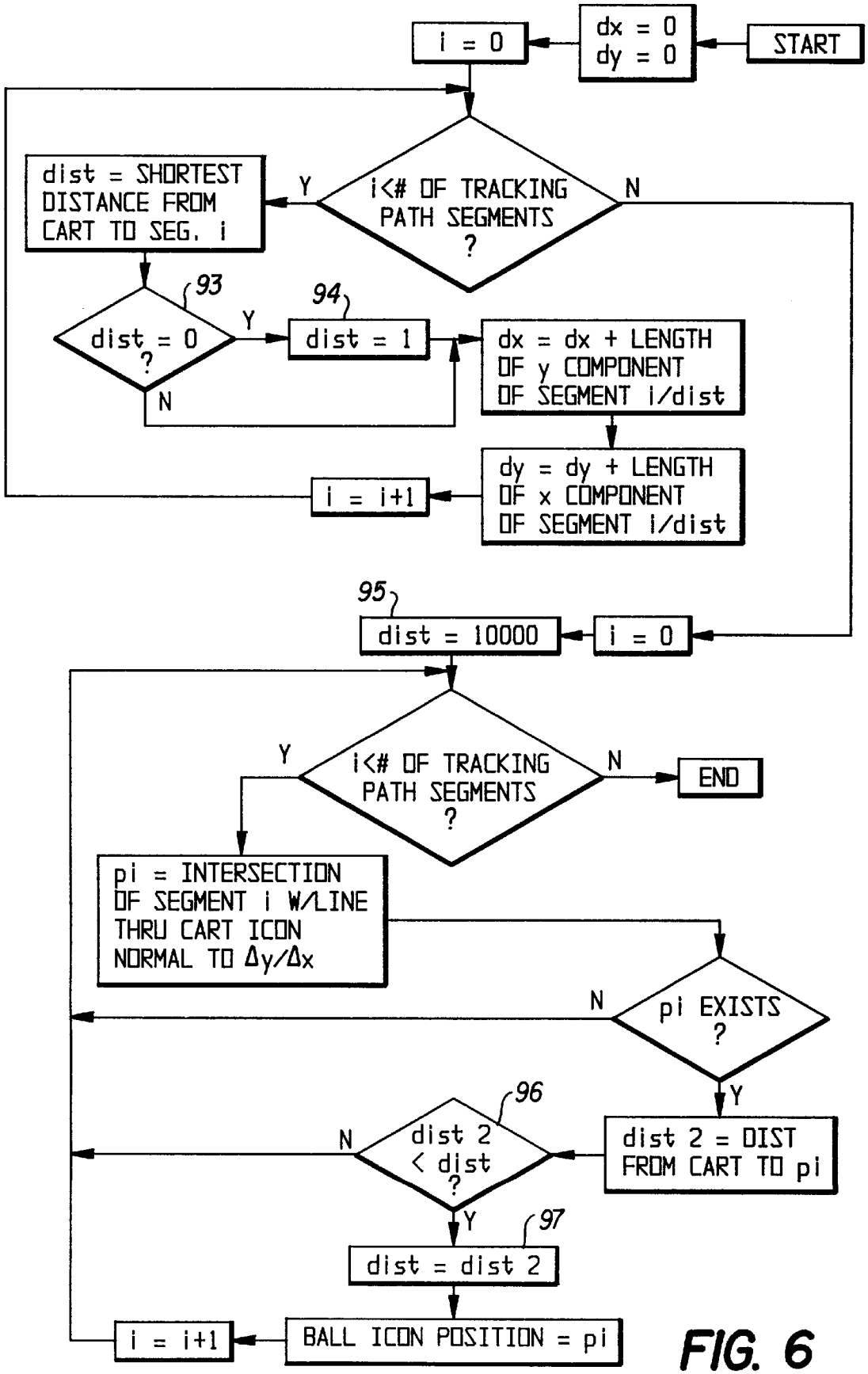
FIG. 6 is a flow diagram of the ball icon tracking algorithm.

In FIG. 6, the implementation of a technique for smooth movement of the ball icon on the tracking line in unison with the cart icon's movement on the cart path is illustrated by way of a flow diagram. In the Figure, x and y are points in a Cartesian coordinate system, and I is a number from 0 to the total number of ball path segments used to develop the piecewise linear line representing the tracking line or ball icon line that is placed in the map survey database along the longitudinal center-line of the hole (or more accurately, a center-line at least approximately from and through the tee boxes, through the fairway, and at least to and through the green). Other symbols are defined on the flow chart itself.

For each segment of the tracking line, the distance to the cart icon is computed as the distance relative to the closest point on the segment. Accordingly, whenever the cart icon is beyond the end of a segment, the distance computed is to the closest end point of the segment. The change in x and y (i.e., dx and dy) for each segment is determined and divided by the distance just computed. These quotients are then averaged to obtain a weighted delta x($\Delta x$) and delta y($\Delta y$). The slope $\Delta y/\Delta x$, then, is computed and represents the slope of the tracking line at the point closest to the cart icon (i.e., in segment I). A line is established through the cart icon with a slope normal to $\Delta y/\Delta x$, and the ball icon is positioned at the intersection of that line with the tracking line (i.e., at pi for the segment I). The computations are made repeatedly by the microprocessor as the cart icon position changes (moving along the cart path line on the displayed map with changes indicated by the positioning/navigation system as the cart itself moves along the cart path on the course). In this way, the ball icon position on the display is repeated updated so that it moves side by side and in unison with the cart icon, the former smoothly along the tracking line as the latter moves along the cart path.

In the flow diagram of FIG. 6, the sequence of boxes 93 and 94 is used to avoid a requirement to divide by zero. For box 95, the figure of 10,000 is not critical, as any arbitrarily large number will suffice. The sequence of boxes 96 and 97 examines whether the segment path is significantly bent.

From the foregoing description, it will be understood that the remote golf ball locator system of the invention enables the golfer using a cart incorporating the principles of the invention to obtain distance computations on the cart monitor screen, overlying the displayed map, to the cup or any other feature of interest whose position is stored in the system and selected by the golfer, relative to the approximate actual position of the lie of the golf ball on the course, and to do so regardless of the cart driving rule imposed by the course administrator. That is, when the rule is "cart path only", whether that rule is invoked permanently or only temporarily, the system enables the golfer to view a ball icon on the screen and to position that icon at the approximate actual position of the ball in play on the course. Such positioning may be done simply by driving the cart to a point on the cart path which is relatively aligned with a line perpendicular to the ball so that the ball icon is at the observed location on the map, because the ball has been hit to a location at or very near the center of the fairway, or by moving the ball icon (preferably when the movement of the ball icon along the tracking line has stopped) with the positioning device associated with the cart monitor to reside on the displayed map at the estimated (by the golfer) actual position, or lie, of the golf ball on the hole, because the lie of the ball is sufficiently remote from the center of the hole (fairway) that a distance calculation made with respect to the location of the ball icon on the central tracking line would not be completely accurate. In either instance, the calculation relative to the ball icon (adjusted for scale of the map to give actual yardage from the ball) will always be a considerably more accurate representation of actual distance from the ball to the feature than a calculation relative to the location of the cart, as is generally done with heretofore existing systems.

When the rule is other than "cart path only", there is typically no need for a special ball locator artifice because the cart may be driven sufficiently close to the lie of the ball that a distance calculation made with respect to the carts position on the hole or the course is quite adequate for the golfer's purposes.

Although certain preferred embodiments and methods have been described to illustrate the best mode presently contemplated of practicing the invention, it will be clear to those skilled in the art that modifications may be made without departing from the true spirit and scope of the invention. Accordingly, it is intended that the invention be limited only to the extent required by the appended claims and the rules and principles of the relevant law.

What is claimed is:

1. A method for obtaining accurate representations of distance from a golf ball to features of interest on a hole of a golf course including tee box, cup and pin locations, water hazards, sand traps, areas of rough adjacent fairway, and cart path, using a golf cart equipped with computerized navigation system including a display monitor, to assist golfers in playing the hole, wherein the golf course has been surveyed so that fixed positions of at least some of said features including the cart path and outline of the hole are known and are part of a map of the course stored in the database of the navigation system for selective display of the map or portion thereof on the cart monitor screen during play of the course, the navigation system having a capability to detect and indicate the real time position of said golf cart for display as a cart icon in the map on the monitor screen, said method comprising the steps of:

providing in the map database a ball icon line substantially along the center of the hole from tee box to green approximating the longitudinal center-line of the hole;

displaying a ball icon distinct from the cart icon in the map on the monitor screen, to move along said ball icon line in juxtaposition with movement of the cart icon along the cart path;

calculating and displaying distance, in actual scale on the course, from the ball icon to the pin on the monitor screen; and providing a capability to move the ball icon from the ball icon line to a position approximating the lie of a ball in play on the hole, whereby to display approximate actual distance therefrom to the pin.

2. The method of claim 1, including calculating and displaying distance, in actual scale on the course, from the ball icon to features on the map respectively selectable on the monitor screen, whereby to display approximate actual distance from the ball to a selected feature when the ball icon is moved from the ball icon line to said position approximating the lie of the ball.

3. The method of claim 2, including performing said calculating and displaying distance only when movement of the ball icon is stopped.

4. The method of claim 2, including causing said ball icon to move relatively smoothly along said ball icon line despite presence of any sharp curves therein relative to the pathway orientation of the cart path.

5. The method of claim 2, including stopping movement of said ball icon along the ball icon line when movement of the cart icon stops, and, if the ball icon is moved thereafter from the ball icon line, returning the ball icon automatically to its last position on the ball icon line to resume movement therealong in unison with movement of the cart icon, when the cart resumes movement along the cart path.

6. The method of claim 1, further including the step of shifting to calculating and displaying distances from the cart icon to selected features, unless a "cart path only" rule is being invoked by the golf course during play of the hole with the cart.

7. The method of claim 6, further including the step of suppressing display of the ball icon unless a "cart path only" rule is being invoked by the golf course during play of the hole with the cart.

8. The method of claim 7, including automatically performing said shifting and suppressing if the announced cart driving rule for the course is other than "cart path only".

9. Apparatus for obtaining accurate representations of distance from a golf ball to features of interest on a hole of a golf course including tee box, cup and pin locations, water hazards, sand traps, areas of rough adjacent fairway, and cart path, using a golf cart equipped with computerized navigation system including a display monitor, to assist golfers in playing the hole, wherein the golf course has been surveyed so that fixed positions of at least some of said features including the cart path and outline of the hole are known and are part of a map of the course stored in the database of the navigation system for selective display of the map or portion thereof on the cart monitor screen during play of the course, the navigation system having a capability to detect and indicate the real time position of said golf cart for display as a cart icon in the map on the monitor screen, comprising:

means for storing in the map database a tracking line substantially from tee box to green approximating the longitudinal center-line of the hole;

means for displaying a ball icon for movement along said tracking line in juxtaposition with movement of the cart icon along the cart path on the monitor screen;

means for calculating and displaying distance, in actual scale on the course, from the ball icon to the pin on the monitor screen; and a positioning device for moving the ball icon from the tracking line to a position approximating the lie of a ball in play on the hole, whereby to display approximate actual distance therefrom to the pin.

10. The apparatus of claim 9, wherein said means for calculating and displaying distance is adapted to calculate and display distance, in actual scale on the course, from the ball icon to features on the map respectively selectable on the monitor screen, whereby to display approximate actual distance from the ball to a selected feature when the ball icon is moved from the tracking line to said position approximating the lie of the ball.

11. The apparatus of claim 10, including means for moving said ball icon relatively smoothly along said tracking line despite presence of any sharp curves therein relative to the pathway orientation of the cart path.

12. The apparatus of claim 10, including means for restoring the ball icon automatically to its last position on the tracking line after having been moved therefrom to obtain a calculation of distance relative to the ball, to resume movement along the tracking line in juxtaposition with movement of the cart icon, when the cart resumes movement along the cart path.

13. The apparatus of claim 10, including means for shifting to calculating and displaying distances from the cart icon to selected features, unless a "cart path only" rule is being invoked by the golf course during play of the hole with the cart.

14. The apparatus of claim 13, including means for suppressing display of the ball icon unless a "cart path only" rule is being invoked by the golf course during play of the hole with the cart.

15. A method of providing a golf course position and distance system with the capability to indicate distance from a golf ball in play rather than from a golf cart that utilizes the position and distance system, wherein the golf cart is equipped with a monitor for displaying a map of the course or portion thereof being played, and for further displaying a depiction of the real time position of the cart on the map to aid the cart user in playing the course, and wherein the display includes a pointer for designating a feature of the course including a cup or pin, hazards, traps, fairway, green, rough, cart path, and outline of a hole being played incorporated in the map for which distance from the cart is to be displayed on the monitor screen, said method comprising the steps of:

displaying a depiction of a golf ball that tracks, along a line running substantially the length of the hole from tee box to green and substantially parallel to at least one side boundary of the hole, the movement of the cart depiction along the hole, so that the ball depiction remains on the tracking line substantially alongside the cart depiction on the monitor screen as play proceeds along the hole, and from which distance is calculated to those of the features selected with the pointer; and enabling selective repositioning of the ball depiction off the tracking line to approximate the lie of an actual golf ball in play, to display the approximate actual distance from the golf ball, rather than from the cart, to a selected feature on the monitor screen.

16. The method of claim 15, wherein said tracking line approximates the longitudinal center-line of the hole.

17. The method of claim 15, including causing the ball depiction to move smoothly along the tracking line despite the presence of a curve in the tracking line.

18. The method of claim 15, including causing the ball depiction to track stops of the cart depiction, and wherein said selective positioning of the ball depiction off the tracking line is permitted only when the ball depiction is at a stop.

19. The method of claim 15, including automatically returning the ball depiction to the last position occupied thereby on the tracling line after the ball depiction has been moved from the tracking line, in preparation for resumption of movement therealong in unison with movement of the cart depiction, when the cart resumes travel along the cart path.

20. The method of claim 15, further including eliminating the display and selective positioning of the ball depiction when a "cart path only" rule is suspended, and thereupon reverting to display of distances to selected features from the cart depiction rather than from the ball depiction.

* * * * *